US005744289A

United States Patent [19]

Kobayashi et al.

[11] Patent Number: 5,744,289

[45] Date of Patent: Apr. 28, 1998

[54] SOLID PROCESSING AGENT PACKAGING BODY FOR SILVER HALIDE PHOTOGRAPHIC MATERIAL AND PROCESSING AGENT SUPPLYING METHOD

[75] Inventors: Hideo Kobayashi; Shinji Shikata; Tomohiro Uchida, all of Hino, Japan

[73] Assignee: Konica Corporation, Japan

[21] Appl. No.: 827,050

[22] Filed: Mar. 25, 1997

[30] Foreign Application Priority Data

Jul. 10, 1995 [JP] Japan ..... 8-180585
Mar. 29, 1996 [JP] Japan ..... 8-076563

[51] Int. Cl.[6] ..... G03C 5/29; G03C 7/407; B65D 33/02

[52] U.S. Cl. ..... 430/465; 430/458; D7/550; D7/553; D9/305; D9/433; 383/119; 383/209; 383/906

[58] Field of Search ..... 430/465, 458; D9/305, 433; D7/550, 553; 383/119, 209, 906

[56] References Cited

U.S. PATENT DOCUMENTS

| | | | |
|---|---|---|---|
| 3,429,432 | 2/1969 | Cabernoch et al. | 383/209 |
| 3,747,756 | 7/1973 | Wheeler | D7/550 |
| 5,480,768 | 1/1996 | Ishida et al. | 430/465 |
| 5,587,277 | 12/1996 | Yamashita et al. | 430/465 |

OTHER PUBLICATIONS

European Search Report EP 97 10 5300, Jul. 1997.

Patent Abstracts of Japan Publication #07128832, dated May 19, 1995 (one page).

Patent Abstracts of Japan Publication #06266084, dated Sep. 22, 1994 (one page).

Patent Abstracts of Japan Publication #06082988, dated Mar. 25, 1994 (one page).

*Primary Examiner*—Hoa Van Le
*Attorney, Agent, or Firm*—Jordan B. Bierman; Bierman, Muserlian and Lucas

[57] ABSTRACT

A solid processing agent packaging body comprises (1) a moisture proof bag; (2) an internal plate member including an approximately rectangular-shaped base plate and three side plates provided on three sides of the base plate and bent in the same direction so that the three side plates define three inner side surfaces and a floor surface of the base plate on the internal plate member and the three inner side surfaces and the floor surface form an accommodation space; and (3) solid processing agents. The moisture proof bag has a sealed open portion at a position corresponding to an open side of the base plate on which the three side plates are not provided so that the solid processing agents are discharge from the accommodation space through the open side of the base plate and the opened sealed open portion of the moisture proof bag.

14 Claims, 8 Drawing Sheets

SOLID PROCESSING AGENT PACKAGING BODY FOR SILVER HALIDE PHOTOGRAPHIC MATERIAL AND PROCESSING AGENT SUPPLYING METHOD

BACKGROUND OF THE INVENTION

The present invention relates to a packaging body for processing agents for an automatic processing machine used for processing silver halide light-sensitive photographic materials or a processing solution producing machine for silver halide light-sensitive photographic materials, and, to be more specific, a packaging body for solid processing agents used for silver halide light-sensitive photographic materials for x-ray irradiation.

Heretofore, processing materials for the automatic developing machine such as developing solution or fixing solution has been supplied to the developing machine in the state of liquid and contained in a polymer bag or a polymer bottle.

However, because of being a liquid, increased weight and volume have been required; supplying operation to the automatic processing machine is not simple, and, considerable labor and room have been necessary for transport, physical distribution and inventory control. Further, in addition to room for stock and labor and time for the treatment of wastes have been required, there have been problems of contamination due to leak or dropping of the liquid and freezing of the processing liquid in the cold district and improvement in these respects have been demanded.

SUMMARY OF THE INVENTION

The objective of the present invention in light of the above-mentioned problems is to provide a high quality container for processing agents having high quality, whereby by replacing the container for the processing agents for automatic developing machines with a packaging body for solid processing agents, whereby supplying operation, inventory control and disposability can be improved remarkably, and troubles due to being a liquid has been eliminated.

The above-mentioned objective of the present invention has been achieved by the structure of the present invention below:

1. A packaging body for solid processing agents for a silver halide light-sensitive photographic material is characterized in comprising:
   an internal plate member comprising an approximately rectangular-shaped base plate and side plates formed by folding and extending three sides of said base plate in the same direction, and
   a bag-shaped member in which said internal plate member is accommodated.
2. The packaging body for solid processing agents for a silver halide light-sensitive photographic material described in (1) is characterized in that the bag-shaped member is a moisture-proof bag comprising a 10 to 40 μm thick outermost layer made of PET or nylon, a 20 to 80 μm thick innermost layer made of LDPE, LLDPE or EVA layer and a 3 to 20 μm thick intermediate layer made of aluminum foil.
3. The packaging body for solid processing agents for a silver halide light-sensitive photographic material described in (1) is characterized in that the bag-shaped member is a moisture-proof bag comprising a 10 to 40 μm thick outermost layer made of PET or nylon, a 20 to 80 μm thick innermost layer made of LDPE, LLDPE or EVA layer and an inorganic material-deposited transparent or semitransparent PET layer whose moisture permeating degree is not higher than 3.5 g/m$^2$. 24 hs as an intermediate layer.
4. The packaging body for solid processing agents for a silver halide light-sensitive photographic material described in (2) or (3) is characterized in that the bag-shaped member is a moisture-proof bag having a layer made of PET or nylon between the above-mentioned aluminum layer and the innermost layer.
5. The packaging body for solid processing agents for a silver halide light-sensitive photographic material described in any one of (1), (2), (3) or (4) is characterized in that the moisture-proof bag comprises an intermediate layer which is made of a transversely and mono-axially oriented PE or transversely and mono-axially oriented PP, the tensile strength of which in the transverse direction is not more than 800 kg/m$^2$, that in the longitudinal direction is not less than 2,000 kg/m$^2$ and thickness being 10 to 50 μm.
6. The packaging body for solid processing agents for a silver halide light-sensitive photographic material described in any one of (1) through (5) is characterized that the moisture-proof bag is a gusseted-type bag having an opening portion on its back seal portion by which the bag can be opened and width of the above-mentioned web-shaped portion is 5 to 25 mm.
7. The packaging body for solid processing agents for a silver halide light-sensitive photographic material described in any one of (1) through (5) is characterized in that the moisture-proof bag is a flat bag comprising a notch portion and a distance between said notch portion and the front end of the internal plate member contained in the bag being 0 to 30 mm.
8. The packaging body for solid processing agents for a silver halide light-sensitive photographic material described in (7) is characterized in that a tear resistant material is provided approximately parallel to the opening direction between the above-mentioned notch portion and the seal portion of the opening side of said packaging body.
9. The packaging body for solid processing agents for a silver halide light-sensitive photographic material described in any one of (1) through (8) is characterized in that the internal plate member is made of a paper material having a surface having a friction coefficient not greater than 0.6 with which the solid processing agent comes in contact.
10. The packaging body for solid processing agents for a silver halide light-sensitive photographic material described in any one of (1) through (8) is characterized in that the internal plate member is made of a composite material consisting of a paper and a 20 to 200 μm thick plastic film laminated on at least one surface of the paper, wherein the composite material has a surface having a friction coefficient not greater than 0.6 with which the solid processing agent comes in contact.
11. The packaging body for solid processing agents for a silver halide light-sensitive photographic material described in any one of (1) through (8) is characterized in that the internal plate member is made of a paper material having an amount of water content no greater than 25 g/m$^2$ in the time of being accommodated in the moisture proof bag.
12. The packaging body for solid processing agents for silver halide light-sensitive materials described in any one of (1) through (8) is characterized in that the internal plate member is a plastic having a surface having a static friction coefficient not greater than 0.6 with which the solid processing agents come in contact.

13. The packaging body for solid processing agents for silver halide light-sensitive materials described in any one of (1) through (12) is characterized in that a surface of the approximately rectangular-shaped base plate member has a plurality of rail-shaped convex, to reduce contacting area with the tablet type solid processing agents.

14. A method of supplying processing agents to an automatic processing machine comprising:

a steps of opening a part of a bag-shaped member corresponding to the one side having no extended portion of a base plate of an internal plate member which comprises the approximately rectangular-shaped base plate and three side plates extended from three sides of said base plate, said three side plates forming three side faces of the internal plate member by folding themselves to the same direction; and a step of supplying solid processing agents for silver halide light-sensitive photographic materials contained therein.

BRIEF DESCRIPTION OF THE DRAWINGS

FIG. 6 is a perspective view showing an entrance section of the processing agent into an automatic processing machine, in which the packaging body is in the state of stand-by.

DETAIL DESCRIPTION OF THE PREFERRED EMBODIMENT

The solid processing agents used in the present invention include those in the state of powder, granule, tablet or globule. Preferably, they are in the shape of tablet.

Examples of the packaging body for containing solid processing agents is explained with reference to the attached drawings.

Figure 1:
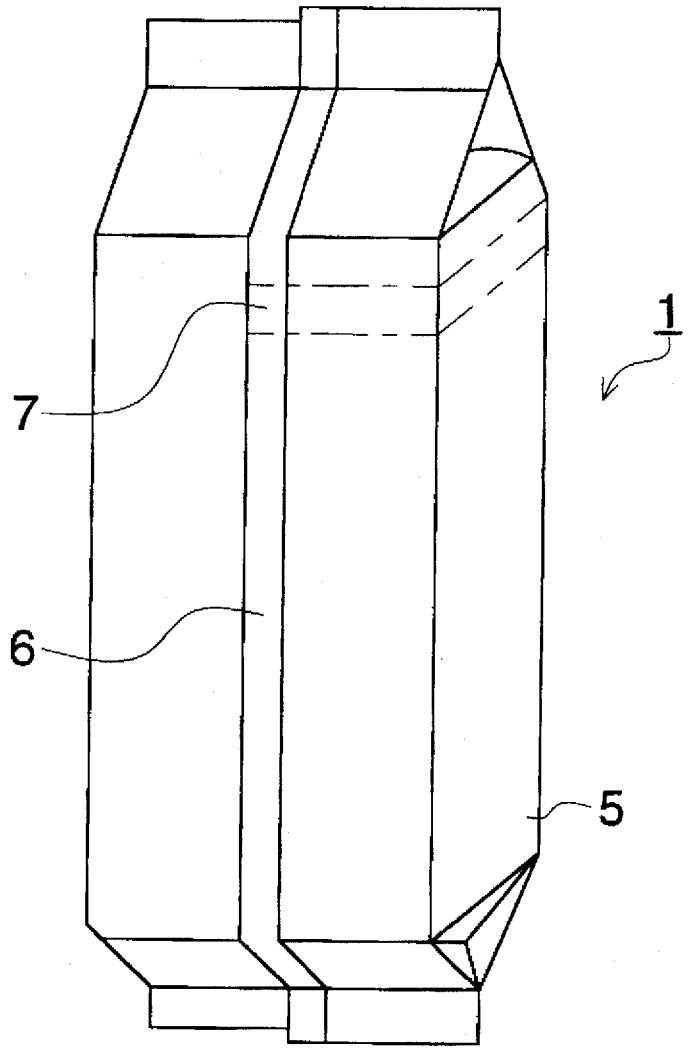
FIG. 1 is a perspective view of the packaging body according to the present invention, showing a gusseted-type.

FIG. 1 shows a gusseted-type packaging body 1 for the solid processing agents.

Figure 2:
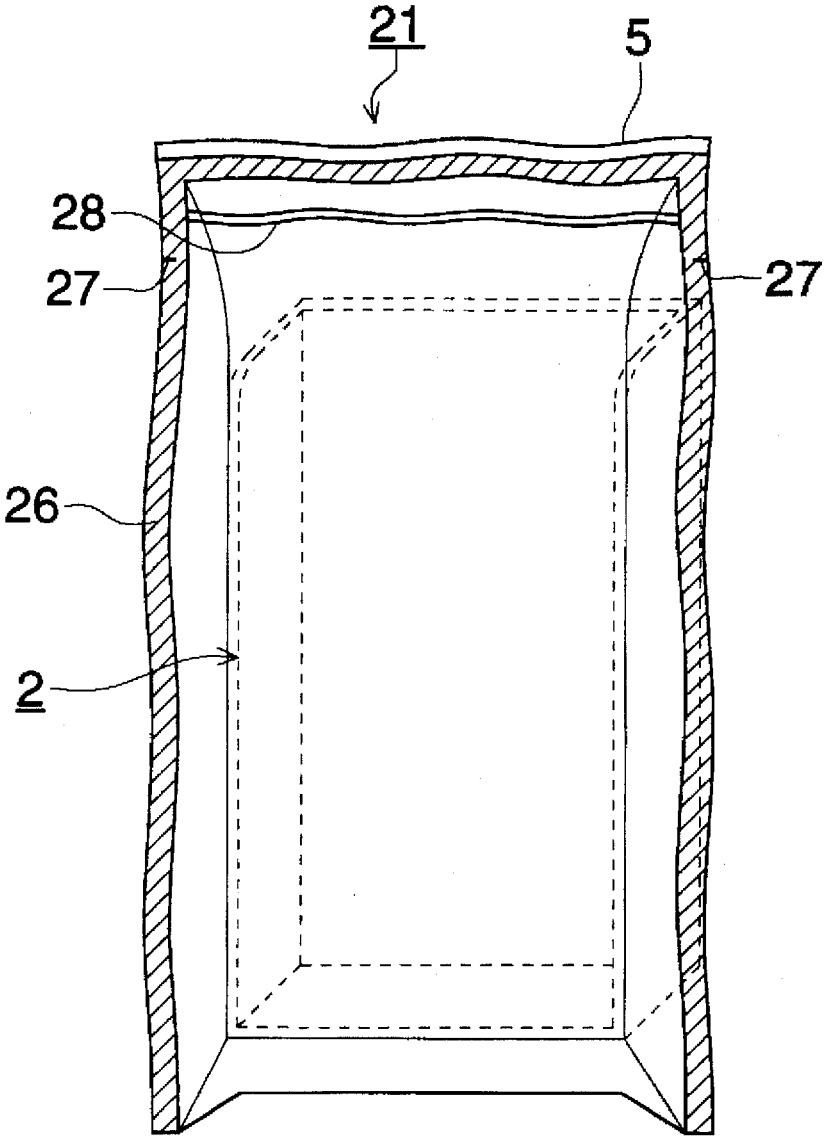
FIG. 2 is a perspective view of the packaging body according to the present invention, showing a plain-bag-type.

FIG. 2 shows a plain bag-type packaging body for solid processing agents 21 according to the present invention.

Below, among solid processing agents used in the present invention examples, tablet-type processing agents used in the present invention, have been contained, are shown. The above-mentioned packaging body 1 and 21 are structured with a moisture-proof bag 5 and an internal plate member 2, and the tablet-type solid processing agents J are contained in the internal plate member 2.

FIG. 2 shows a plain-type moisture-proof bag, wherein a notch portion 27 for opening has been formed at the end portion of a sealing portion 26, by which opening operation can be made surely and easily. Moreover, one in which a tear-resistant member 28 is arranged between the notch portion and a seal portion of the releasing side and the sealing part of a releasing side is also shown.

Figure 3:
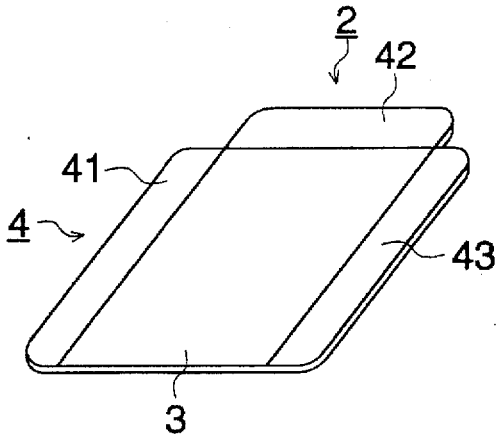
FIGS. 3(*a*) to 3(*c*) are perspective views of the internal plate member according to the present invention, showing the internal plate member having folded side plates and convex side plates on the base plate.
Figure 3:
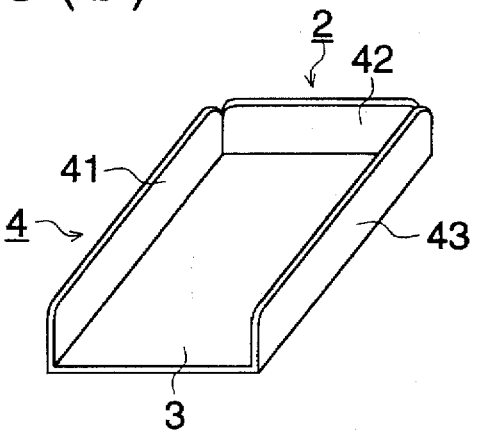
Figure 3:
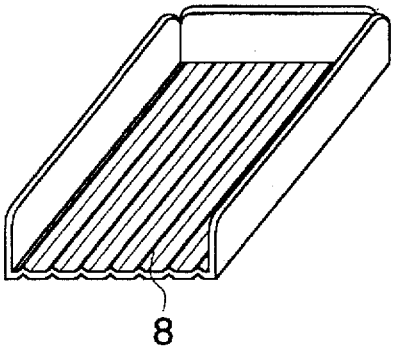

FIG. 3 shows the internal plate member 2 comprising an approximately rectangular-shaped base plate 3 and side plates extended from three sides of said rectangular-shaped base plate, 41, 42 and 43 (FIG. 3(*a*) and said extended side plates form three faces by folding themselves to the same direction with respect to the base plate (FIG. 3(*b*)).

Figure 4:
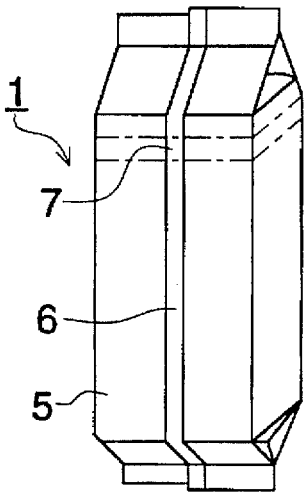
FIGS. 4(*a*) and 4(*b*) are perspective views showing the state of the internal plate member and solid processing agent J according to the present invention, in which the opening portion is opened.
Figure 4:
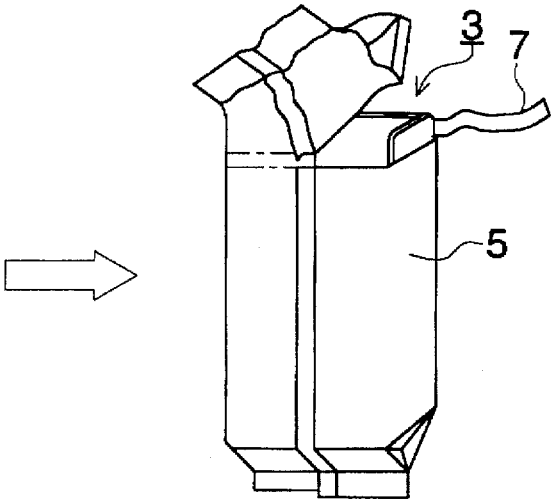

FIG. 4(*a*) shows an opening portion 7 provided on the back seal portion of the moisture-proof bag 5, and 4(*b*) shows a state of opening the bag by cutting out a portion of the moisture-proof bag.

Figure 5:
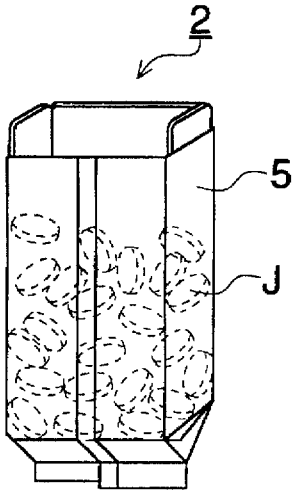
FIGS. 5(*a*) and 5(*b*) are perspective views showing a state in which the packaging body is opened, and tablet type or granule type solid processing agents are contained therein
Figure 5:
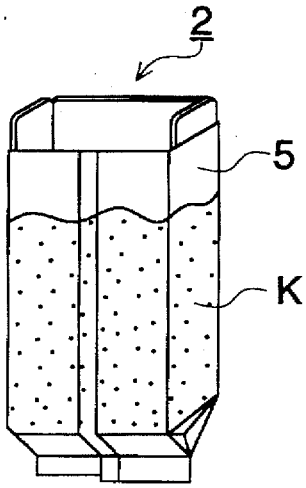

FIG. 5(*a*) shows a perspective view showing the packaging body for solid processing agents and state of the tablet type solid processing agents J contained therein.

FIG. 5(*b*) shows a perspective view showing the packaging body for solid processing agents and state of the granule type processing agent K contained therein.

Figure 6:
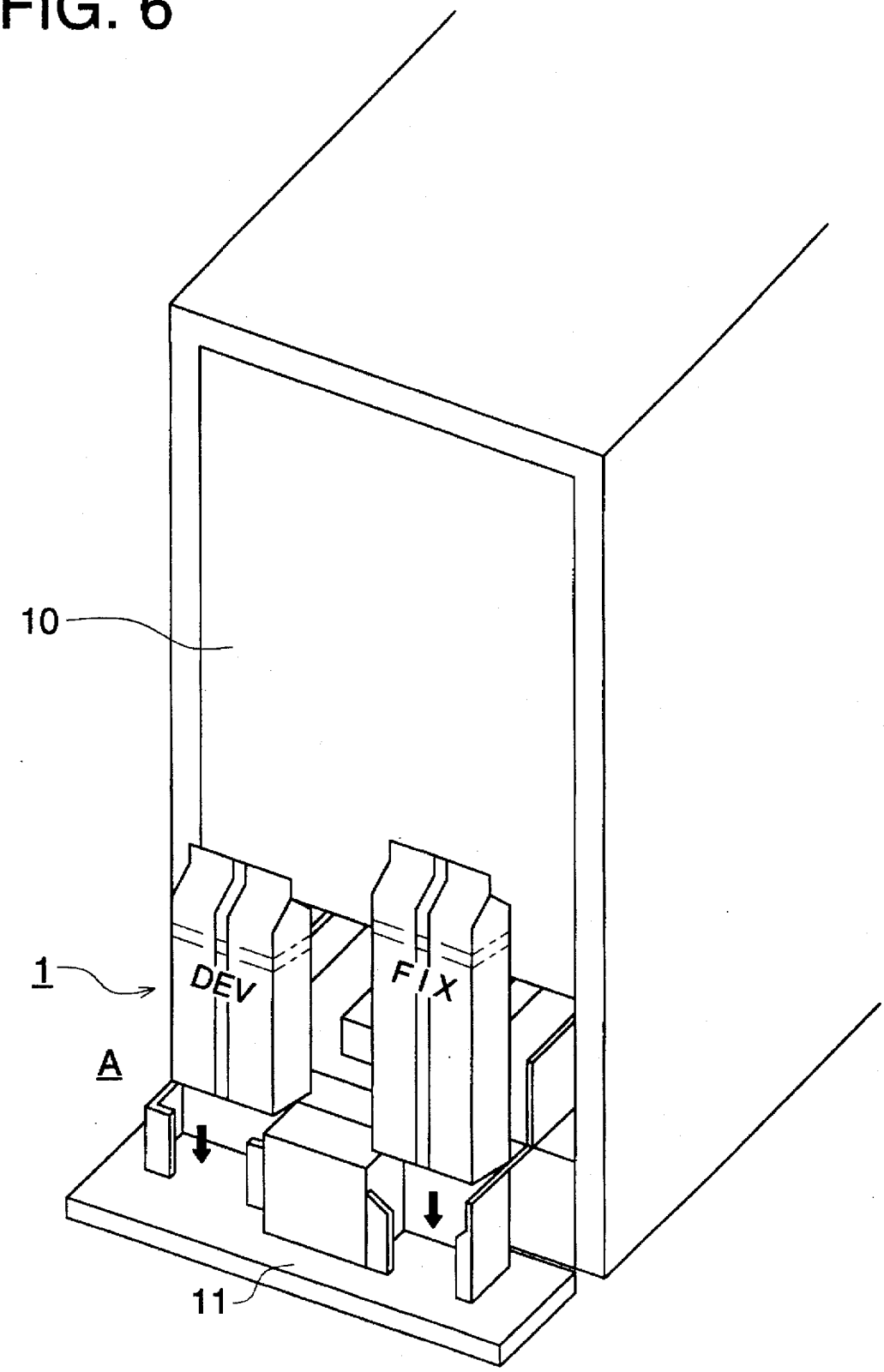
Figure 7:
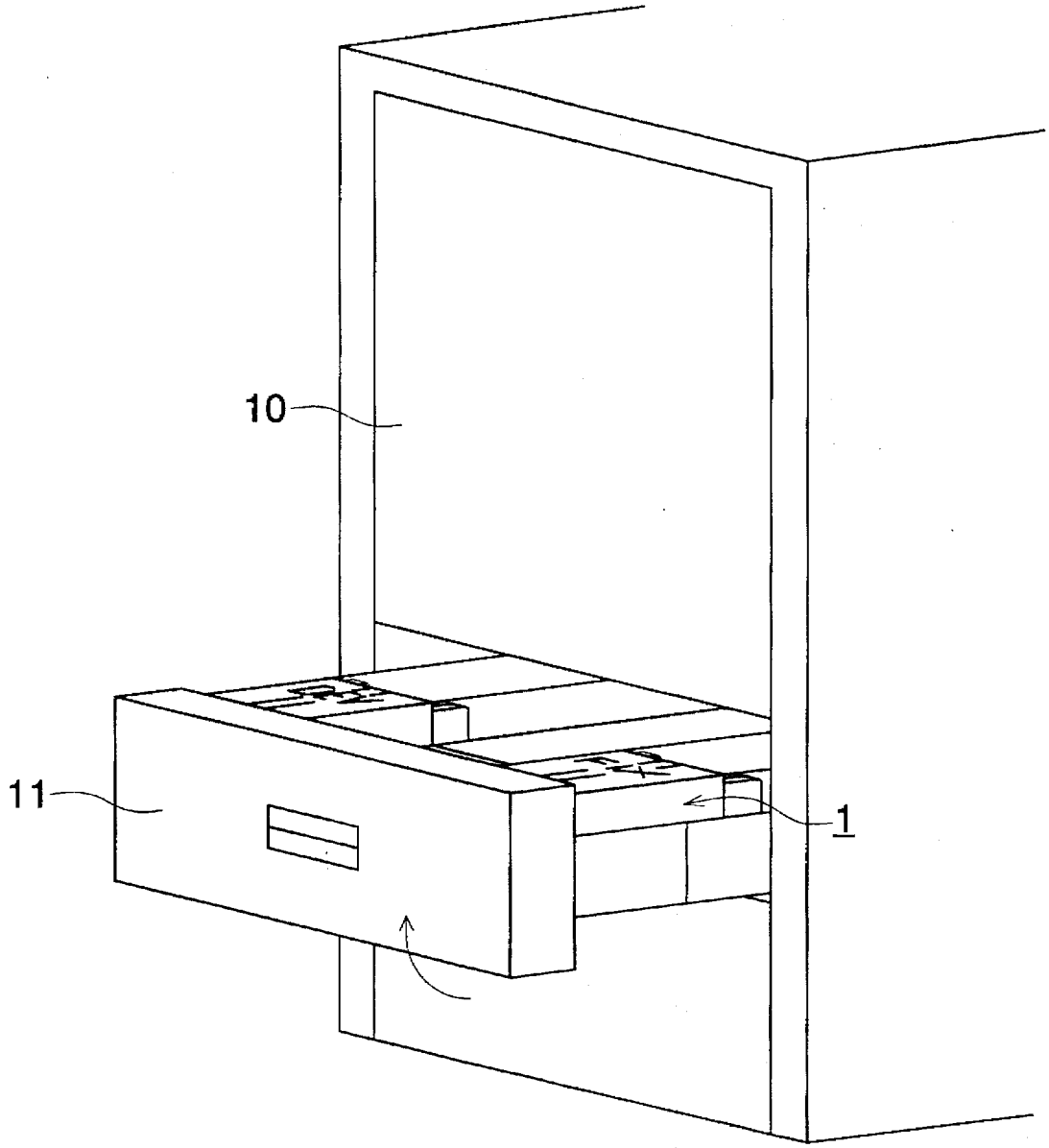
FIG. 7 is a perspective view showing a state in which the solid processing agents have been contained in the entrance portion of the processing agent and are ready to be put into an automatic processing machine.

FIGS. 6 and 7 represent an example of steps of setting and accommodating the tablet-shaped solid processing agents into the automatic developing machine 10. FIG. 6 shows a state in which a solid agent supply section is drawn from the automatic developing machine 10 and the solid processing agent packaging body 1 for developing agent and fixing agent are under preparation for accommodation section 11. In FIG. 7, after loading the solid processing agent packaging body 1 on the solid agent supply section, a part of the moisture-proof bag is cut out in the shape of a web from an opening portion 7 provided the back seal portion 6. FIG. 7 shows a state in which the solid processing agent packaging body 1 is set and accommodated in the solid agent supply section of the automatic developing machine 10, after the moisture-proof bag is opened.

Figure 8:
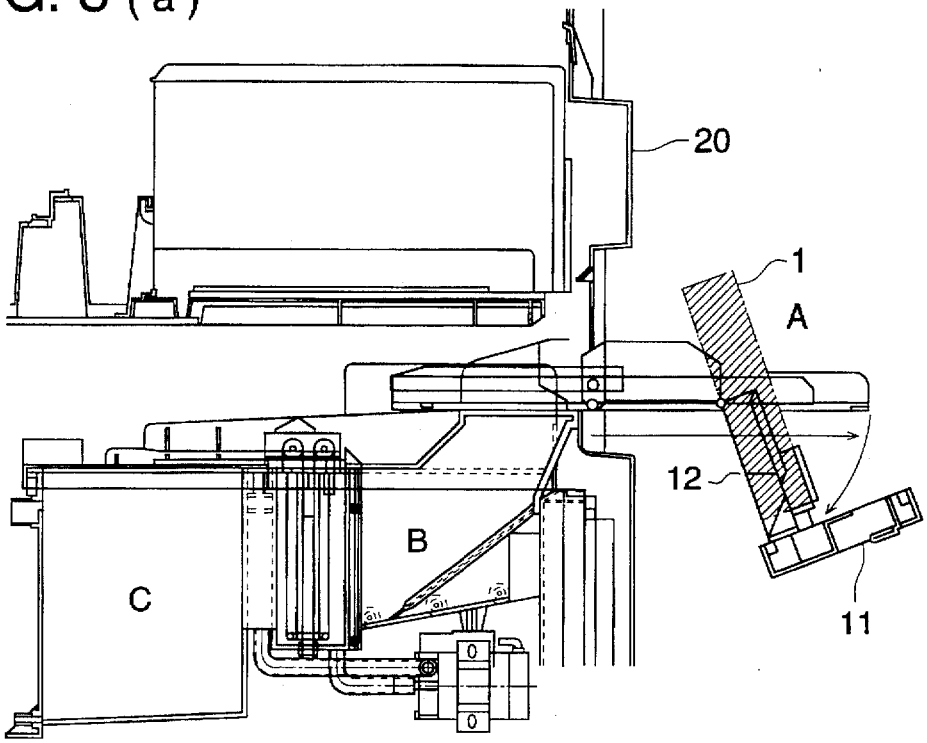
FIGS. 8(*a*) and 8(*b*) are sectional views of a processing solution producing machine 20.
Figure 8:
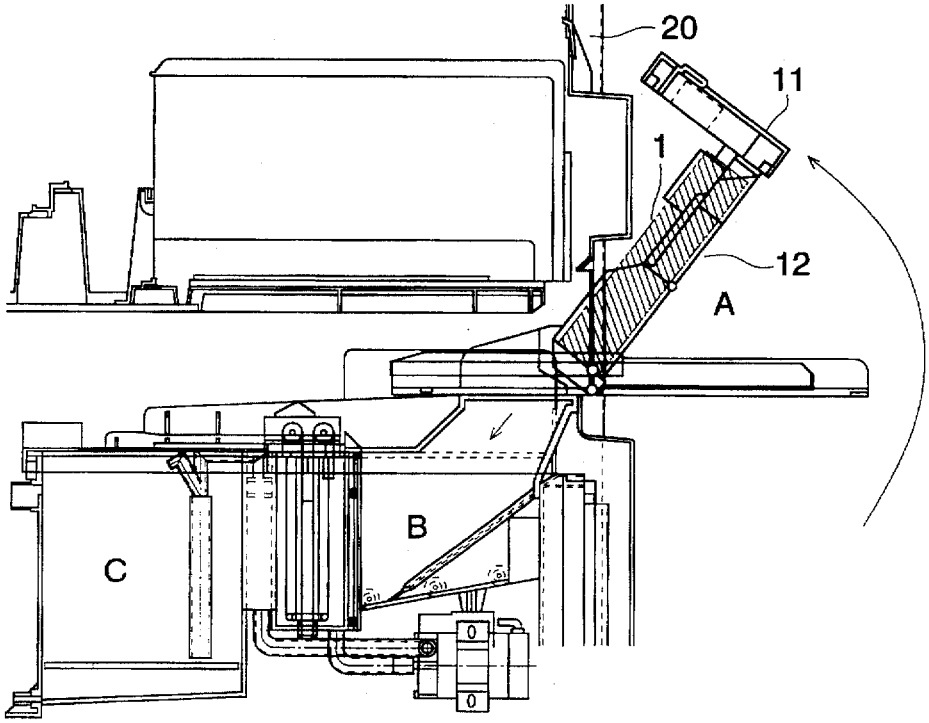

FIGS. 8(*a*) and 8(*b*) are sectional views of a processing solution producing machine 20 and show supplying operations respectively. The processing solution producing machine 20 is provided with the same solid processing supply section A as that provided in the automatic developing machine 10 shown in FIGS. 6 and 7. As shown in FIG. 8(*a*), after a supply table 12 in the processing agent supply section A is drawn in the right direction, the solid processing agent packaging body 1 is set on the accommodating section 11. Thereafter, when the supply table 12 is slanted by lifting the accommodating section 11 upward, the solid processing agent packaging body 1 is slanted on a condition that it's opening is directed downward. Accordingly, the tablet agents slide downward from the opening of the solid processing agent packaging body 1 and are supplied to a solid processing agent dissolving section.

Figure 9:
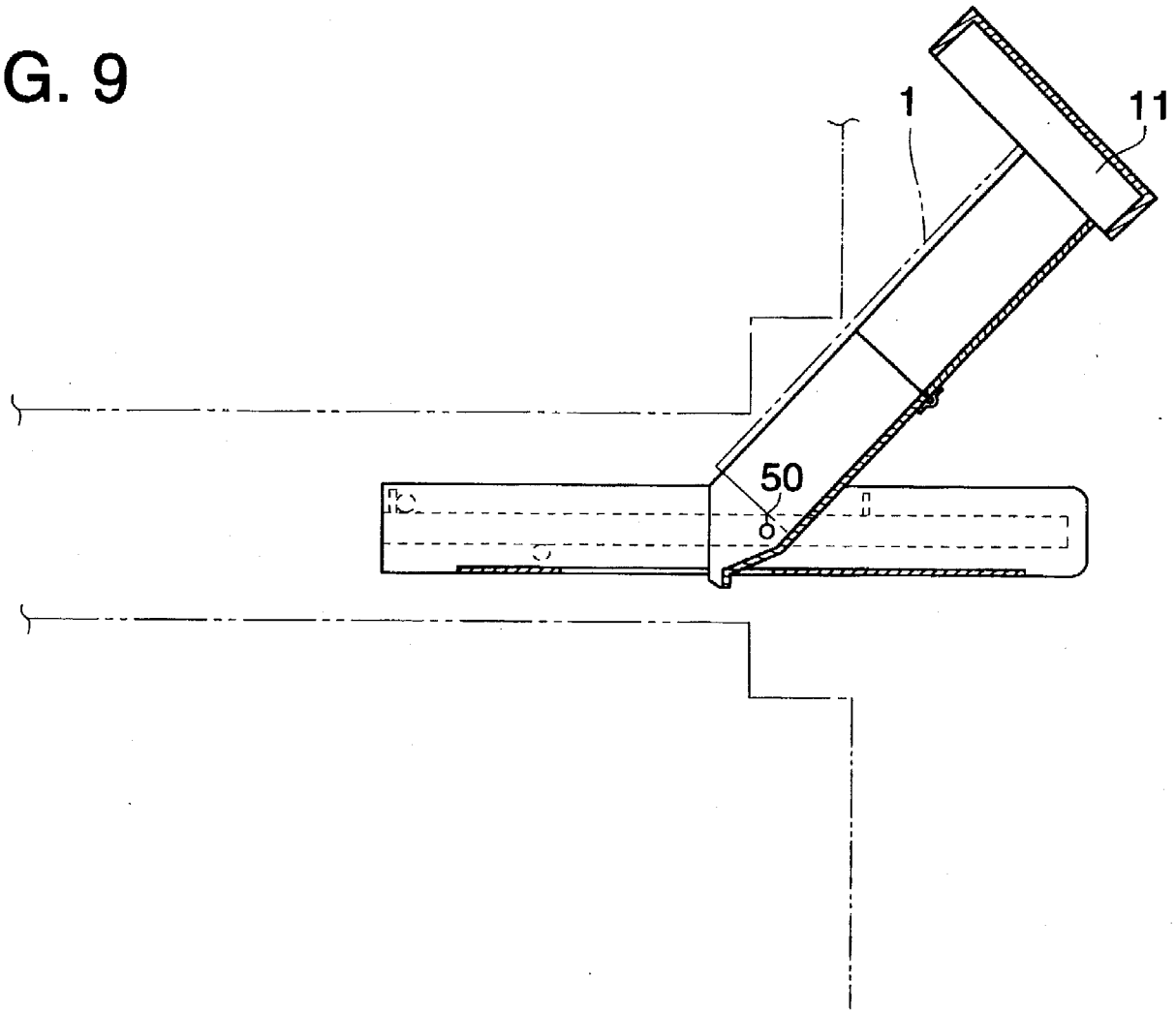
FIG. 9 show an enlarged view of the supply table 12.

FIG. 9 show an enlarged view of the supply table 12. Protrusions 50 are provided on inner sides of the forward portions of the side section of the supply table 12, whereby the downward movement of the slanted solid processing agent packaging body 1 whose opening is directed downward is stopped when the slanted solid processing agent packaging body 1 comes in contact with the protrusion 50.

A preferable structure of the solid processing agent packaging body 1 and 21 is explained hereinafter.

The tablet-type solid processing agents J have a hygroscopic property, the above-mentioned packaging body is required to possess a moisture-proof property.

Accordingly, as an intermediate layer, the moisture-proof bag 5 comprises a 3 to 20 μm thick, more preferably, 5 to 10 μm thick aluminum layer. Further, the moisture-proof bag 5 comprises as an outermost layer a 10 to 40 μm thick, more preferably, 12 to 30 μm thick layer made of PET (polyethylene terephthalate) or nylon in order to prevent pinholes which are apt to be generated during transport or handling.

Instead of the above aluminum layer, an inorganic material-deposited transparent or semitransparent PET layer whose moisture permeating degree is not higher than 3.5 $g/m^2$. 24 hs (40° C., 90% RH) may be used. The inorganic material-deposited PET layer is formed by depositing aluminum oxide or silicon oxide on a PET. A high moisture-proof intermediate layer can be obtained by the inorganic material-deposited PET layer. Further, since inorganic material-deposited PET layer is transparent or semitransparent, a condition of solid processing agent packed in the packaging body 1 can be observed. Therefore, even if solid processing agents remain in the packaging body 1 in the time of supplying the solid processing agents, it is possible to discharge the remained solid processing agents completely from the packaging body to the processing tank or the dissolving tank by vibrating the packaging body while observing the inner condition of the packaging body.

The moisture permeating degree of the moisture proof bag is not higher than 3.5 $g/m^2 \cdot 24$ hs, preferably not higher than 1.5 $g/m^2 \cdot 24$ hs, more preferably not higher than 1.0 $g/m^2 \cdot 24$ hs.

Since solid processing agents have a high hygroscopic property, if the moisture proof bag has a higher moisture permeating degree, the solid processing agents absorb moisture under a high humidity and high temperature condition. Accordingly, surfaces of the solid processing agents become humid and the solid processing agents adhere to the internal plate member. As a result, the supply of the processing agents to the processing tank is obstructed.

After packaging bodies with moisture proof bags having different moisture permeating degree indicated below were preserved under the condition that the temperature was 40° C. and the humidity was 90%, supply tests were conducted for the packaging bodies by using the solid processing agent supply section shown in FIGS. 8(*a*) and 8(*b*). The following test results were obtained.

| Moisture permeating degree of moisture proof bag ($g/m^2 \cdot 24$ hs) | Allowable preserving time period (months) |
|---|---|
| 3.5 | 7 |
| 1.5 | 16 |
| 1.0 | 24 |

When a preserving time period of each packaging body was passed over it's allowable preserving time period, the processing agents were adhered to the internal plate member and the supply failure for the processing tank occurred.

Although there is no specific limit as to shape of the above-mentioned moisture-proof bag 5, a plain bag-type or a gusseted-type bag is preferable in light of easiness of accommodation and opening, and easy fixing to the automatic processing machine.

In order to open the above-mentioned moisture-proof bag 5 surely and load the processing machine with the tablet without failure. In the case of the gusseted-type bag, it is preferable that an opening portion 7, from which the bag can be opened in the shape of a stripe, is provided at the sealing portion at the back of the bag, and, in the case of the plain bag-type, it is preferable that the bag has a notch portion 27 at the side seal portion 26 to open the bag.

Width of the stripe is generally 5 to 25 mm and, preferably, 8 to 20 mm. When the width is smaller than 5 mm, there is a fear that the web is easily cut on its way and when, on the other hand, it is wider than 25 mm, opening operation becomes difficult.

Further in the case of the plain-bag type, by making the distance between the notch portion 27 and front end of the internal plate member 20 to 30 mm, opening operation and accommodation and taking out of the solid processing agents become easier and, therefore, preferable. Still further, in order for the opening operation to be certain, a break-resistant material 28 may preferably be arranged between the above-mentioned notch portion and the seal position of the opening side approximately in parallel with each other.

Herein, the term "break-resistant material" is an element which has a function of guiding the opening line to become approximately linear, and it may be formed using a plastic film( such as nylon, PET, PP, PE, or vinyl chloride, etc.,) having width of not smaller than 1 mm, and thickness of not less than 0.3 mm.

Further, opening of the bag may be performed more surely by providing a mono-axially oriented polyethylene(PE) or a mono-axially oriented propylene(PP), tensile strength in the transverse direction of which is not greater than 800 $kg/m^2$ and, more desirably, not greater than 600 $kg/m^2$, that in the longitudinal direction not more than 2,000 $kg/m^2$ and, more preferably, not more than 2,500 $kg/m^2$ as an intermediate layer.

Still further, by using a 20 to 80 μm thick LDPE(low density polyethylene), LLDPE (linear low density polyethylene) or EVA (ethylene-vinyl acetate copolymer), stable sealing property and opening with small strength become possible.

Still further, there may be a 10 to 40 μm thick PET or nylon layer between the above-mentioned aluminum layer and the innermost layer.

The tablet can easily be accommodated in the automatic developing machine more surely by using a paper material, of which friction coefficient is not greater than 0.6 and weight is 100 to 600 $g/m^2$, or a composite material thereof, in which a plastic film having the friction coefficient of not greater than 0.6 and thickness of 20 to 200 μm has been laminated on at least one surface of said paper material which comes into contact with the processing agents.

In the case that the solid processing agent packaging body 1 is slanted by the processing agent supplying section shown in FIGS. 8(*a*) and 8(*b*) so that the opening of the solid processing agent packaging body 1 is directed downward and solid processing agents slide on the internal plate member so as to be supplied to the processing tank, it is preferable to make a static friction coefficient the internal plate member to be not greater than 0.6.

When the weight is not greater than 100 $g/m^2$, strength of the member becomes weak, and deformation is caused at the time of handling and, thus, fixing to the automatic developing machine may become difficult.

When, on the other hand, the weight is greater than 600 g/m$^2$, it becomes difficult for the side plates formed by extending three sides of the approximately rectangular-shaped base plate to be folded, to assemble the internal plate member. This is not preferable not only in light of lowering working efficiency, but also in light of cost increase.

When a paper material is used as the internal plate member, it is preferable to make an amount of water content contained in the paper material in the time of constructing the solid processing agent packaging body to be not greater than 25 g/m$^2$.

If an amount of the water content is greater, solid processing agents absorb water from the paper material during a preserving period after the solid processing agent packaging body was constructed. Accordingly, surfaces of the solid processing agents become humid and the solid processing agents adhere to each other or the internal plate member. As a result, the supply of the processing agents to the processing tank is obstructed. Further, in addition to the supply failure, color change of solid processing agents or stain on the paper material may occur.

Comparative Test in Terms of Water Content

As shown in Table 1, in the time of constructing solid processing agent packaging bodies, paper materials having a different amount of water content indicated below are packed in the moisture proof bag together with tablet type agents shaped in a form of column having a diameter of 30 mm and a height of 10 mm. Tablet type developing agents (Dev.) are composed of developing agent component tablets A (Dev. A) and developing agent component tablets B (Dev. B) and tablet type fixing agents (Fix.) are composed of fixing agent component tablets A (Fix. A) and fixing agent component tablets B (Fix. B). The solid processing agent packaging bodies were preserved in a constant temperature chamber of 50° C. for two weeks respectively. Thereafter, the solid processing agent packaging bodies were opened so as be checked the preserving inner condition of them.

The test results are indicated in Table 1.

TABLE 1

| Amount of water content (g/m$^2$) | 18.7 | | 25.7 | | 32.7 | | 39.0 | |
|---|---|---|---|---|---|---|---|---|
| Kind of tablet | Dev. | Fix. | Dev. | Fix. | Dev. | Fix. | Dev. | Fix. |
| Color change of tablet | No | No | No | No | No | Changed | No | Changed |
| Stain on paper | No | No | No | No | No | No | No | No |
| Adhesion of tablet onto paper | No | No | No | No | No | Occurred | No | Occurred |
| Hardness (Kg) | Dev. A 86 | Fix. A 43 | Dev. A 98 | Fix. A 40 | Dev. A 107 | Fix. A 36 | Dev. A 108 | Fix. A 44 |
| | Dev. B 91 | Fix. B 52 | Dev. B 95 | Fix. B 54 | Dev. B 77 | Fix. B 55 | Dev. B 91 | Fix. B 62 |

Note: The composition of each of the developing agent component tablet A, the developing agent component tablet B, a fixing agent component tablet A and a fixing agent component tablet B are disclosed in Japanese Unexamined Patent Publication No. 8-69098.

As can be seen from Table 1, it is preferable to make the amount of water content of the paper material to be not greater than 25 g/m$^2$, because color change of tablet, stain of paper material, adhesion of tablet onto the paper material were not observed.

The influence of the amount of water content on the hardness of the tablet was not appreciable.

As discussed above, when the internal plate member is made of paper, it absorbs water easily, and affects on the tablet. Therefore, it is preferable to control water content of this paper material. However, when a plastic, of which thickness is 0.1 to 0.8 mm and the static friction coefficient is not greater than 0.6 is used, consideration of the water content becomes unnecessary and management during manufacturing steps become much easier and it is, therefore, preferable.

Further as shown in FIG. 3(*c*), by arranging a plurality of parallel concave 8 on the surface of the approximately rectangular-shaped base plate 3 of the internal plate member 2, touch area with the tablet processing agents can be reduced and this is favorable in light of better accommodation of the tablets. Preferable width of the rail-shaped concave portion is 0.5 to 10 mm and height is 0.1 to 4 mm.

As discussed above, the internal plate member is shaped in a form of box by an approximately rectangular-shaped base plate and side plates formed by folding and extending three sides of said base plate in the same direction, and an outer figure of the solid processing agent packaging body 1 is formed by the internal plate member. Since a side plate is not provided to a side of the internal plate member opposite to the opening portion of the solid processing agent packaging body, the opening portion of the solid processing agent packaging body is easily opened. That is, the opening section can be cut linearly along the side to which the side plate is not provided. After the opening portion is opened, an operation to discharge the solid processing agent can be conducted easily because the side plate is not provided in the vicinity of the opening portion. Since three sides of the base plate are enclosed by the side plates and the solid agents are discharged from the side to which a side plate is not provided, the internal plate member has an excellent function to act as a guide member in the time of discharging the solid processing agent. Furthermore, the internal plate member can be used to stop the downward movement of the slanted solid processing agent packaging body by bring the fore edge of the side plates of the slanted solid processing agent packaging body in contact with protrusion 50 as shown in FIG. 9.

As explained hereinabove, the packaging body for solid processing agents for silver halide light-sensitive photographic materials according to the present invention is characterized in that it comprises an internal plate member 2 comprising an approximately rectangular-shaped base plate 3 and side plates 4 formed by extending and folding said side plates at three sides of said base plate and a moisture-proof bag 5 containing said internal plate member 2.

The moisture-proof bag has a 10 to 40 μm thick outermost layer made of PET or nylon, a 20 to 80 μm thick innermost layer made of LDPE, LLDPE or EVA and a 3 to 20 μm thick intermediate aluminum layer.

In the above-mentioned moisture-proof bag, the tensile strength of the bag in the transverse direction is not greater than 800 kg/m$^2$, that in the longitudinal direction is not smaller than 2,000 kg/m$^2$, and thickness is 10 to 50 mm; and that the bag has an intermediate layer made of transversely and mono-axially oriented EP or transversely and mono-axially oriented PP as an intermediate layer; and, further, said moisture-proof bag comprises, as an intermediate layer made of PET or nylon layer between said aluminum layer and the innermost layer.

Further, the present invention is characterized in that the above-mentioned moisture-proof bag is of a plain bag-type or of a gusseted-type. In the case of the plain-bag type, a notch portion 27 is comprised at sealing portion 26 for opening the bag, and, in the case of the gusseted type, the opening portion 7 is provided from the back seal portion 6 in the shape of a web and width of said web-shaped member is 5 to 25 mm. In the case of notch, distance between the notch portion 27 and the front edge of said internal plate member 2 contained is 5 to 30 mm.

Still further, the present invention is characterized in that the internal plate member 2 is a paper material, of which weight is 100 to 600 g/m$^2$ the friction coefficient is not greater than 0.6, and thickness is 20 to 200 mm or a composite material consisting of a paper and a 20 to 200 μm thick plastic film laminated on at least one surface of the paper, wherein the plastic film has a fiction coefficient not greater than 0.6.

The internal plate member 2 is a plastic whose thickness is 0.1 to 0.8 mm and fiction coefficient is not greater than 0.6.

Further, a surface of the approximately rectangular-shaped base plate member 3 has a plurality of rail-shaped convex, to reduce contacting area with the tablet type solid processing agents.

In a solid processing agent packaging body for a silver halide photographic material wherein the packaging body is composed of an internal plate member and a bag-shaped member, the internal plate member comprises an approximately rectangular-shaped base plate and three side plates extended from three sides of said base plate, and the three side plates are bent in the same direction so as to form three side surfaces, the present invention provides a processing agent Supplying method characterized in that a part of the bag-shaped member corresponding to the one side having no extended portion of the base plate of the internal plate member is opened by a sealed opening portion and accommodated tablet type solid processing agents J for silver halide photographic material are surely supplied to the automatic processing machine.

In comparison with conventional processing agents used for an automatic processing machine, wherein the conventional processing agents has been used in the form of a solution contained in a polymer bag or bottle, by employing the solid processing agent packaging body of the present invention, weight and volume have been reduced remarkably; supply to the automatic processing machine has been simplified; time and labor required for the Supplying operation has remarkably been reduced; further, in light of transport, physical distribution and inventory control, labor and space have been reduced; and the present invention is excellent in view of cost performance. Still further, in the day in which much importance is attached to ecological preservation, labor and room necessary for treating wastes have been reduced; and still further in term of quality, problems of contamination due to leaking or dripping of the solution and freezing thereof in a cold district have completely been eliminated; and, thus, excellent packaging body could be provided.

What is claimed is:

1. A solid processing agent packaging body, comprising:

solid processing agents for processing a silver halide photographic material;

an internal plate member including an approximately rectangular-shaped base plate having four sides, and three side plates provided on three sides Of the base plate and bent in the same direction so that the three side plates define three inner side surfaces and a floor surface of the base plate on the internal plate member and the three inner side surfaces and the floor surface form an accommodation space; and a moisture proof bag in which the solid processing agents and the internal plate member are packaged in such a manner that the solid processing agents are accommodated in the accommodation space on the base plates, the moisture proof bag having a sealed open portion which is opened when the solid processing agents are discharge from the moisture proof bag, wherein the sealed open portion is located at a position corresponding to an open side of the base plate on which the three side plates are not provided so that the solid processing agents are discharge from the accommodation space through the open side of the base plate and the opened sealed open portion of the moisture proof bag.

2. The solid processing agent packaging body of claim 1, wherein the moisture proof bag comprises a 10 to 40 μm thick outermost layer made of one of polyethylene terephthalate and nylon, a 20 to 80 μm thick innermost layer made of one of low density polyethylene, linear low density polyethylene and ethylene-vinyl acetate copolymer layer and a 3 to 20 μm thick intermediate layer made of aluminum foil.

3. The solid processing agent packaging body of claim 2, wherein the moisture proof bag comprises a layer made of one of polyethylene terephthalate and nylon between the aluminum layer and the innermost layer.

4. The solid processing agent packaging body of claim 1, wherein the moisture proof bag comprises a 10 to 40 μm thick outermost layer made of one of polyethylene terephthalate and nylon, a 20 to 80 μm thick innermost layer made of one of e of low density polyethylene, linear low density polyethylene and ethylene-vinyl acetate copolymer layer and an inorganic material-deposited transparent or semi-transparent polyethylene terephthalate layer whose moisture permeating degree is not higher than 3.5 g/m$^2$·24 hs as an intermediate layer.

5. The solid processing agent packaging body of claim 1, wherein the moisture proof bag comprises an intermediate layer which is made of one of a transversely and mono-axially oriented polyethylene and transversely and mono-axially oriented propylene, the intermediate layer has a tensile strength in a transverse direction not more than 800 kg/m$^2$, a tensile strength in a longitudinal direction not less than 2,000 kg/m$^2$ and a thickness of 10 to 50 μm.

6. The solid processing agent packaging body of claim 1, wherein the moisture-proof bag is a gusseted-type bag having the sealed open portion shaped in a form of a web on its back sealed portion by which the bag can be opened and width of the web-shaped portion is 5 to 25 mm.

7. The solid processing agent packaging body of claim 1, wherein the moisture-proof bag is a flat bag comprising a notch portion and a distance between the notch portion and the open side of the base plate packed in the bag is 0 to 30 mm.

8. The solid processing agent packaging body of claim 7, wherein a tear resistant material is provided on the moisture roof bag between the notch portion and the sealed open portion in approximately parallel to the opening direction of the sealed open portion.

9. The solid processing agent packaging body of claim 1, wherein the internal plate member is made of a paper material, and the floor surface formed by the paper material has a friction coefficient not greater than 0.6.

10. The solid processing agent packaging body of claim 1, wherein the internal plate member is made of a composite material composed of a paper and a 20 to 200 μm thick plastic film laminated on at least one surface of the paper, and the floor surface formed by the composite material has a friction coefficient not greater than 0.6.

11. The solid processing agent packaging body of claim 1, wherein the internal plate member is made of a paper material having an amount of water content not greater than 25 $g/m^2$ in the time of being accommodated in the moisture proof bag.

12. The solid processing agent packaging body of claim 1, wherein the internal plate member is a plastic, and the floor surface formed by the plastic has a friction coefficient not greater than 0.6.

13. The solid processing agent packaging body of claim 1, wherein a surface of the base plate member is provided with a plurality of rail-shaped convex so that contacting area with the tablet type solid processing agents is reduced.

14. A solid processing agent packaging body, comprising:

solid processing agents for processing a silver halide photographic material;

an internal plate member including an approximately rectangular-shaped base plate having four sides, and three side plates provided on three sides of the base plate and bent in the same direction so that the three side plates define three inner side surfaces and a floor surface of the base plate in the internal plate member and the three inner side surfaces and the floor surface form an accommodation space, wherein the floor surface has a friction coefficient not greater than 0.6; and a moisture proof bag in which the solid processing agents and the internal plate member are packaged in such a manner that the solid processing agents are accommodated in the accommodation space on the base plates, wherein the internal plate member has an amount of water content not treater than 25 $g/m^2$ when the internal plate member is packaged in the moisture proof bag, the moisture proof bag comprising an outer protective layer, an intermediate layer and a inner sealable layer and having a sealed open portion which is opened when the solid processing agents are discharge from the moisture proof bag, wherein the sealed open portion is located at a position corresponding to an open side of the base plate on which the three side plates are not provided so that the solid processing agents are discharge from the accommodation space through the open side of the base plate and the opened sealed open portion of the moisture proof bag.

* * * * *